US007219879B2

(12) United States Patent
Jackson et al.

(10) Patent No.: US 7,219,879 B2
(45) **Date of Patent: *May 22, 2007**

(54) APPARATUS FOR SIGNALING ROTATION OF A WINCH TO AN OPERATOR THEREOF

(75) Inventors: David C Jackson, Jenks, OK (US); Ike Baldwin, Jenks, OK (US); Garry Knight, Santa Ana, CA (US); Simon Worboys, Santa Ana, CA (US)

(73) Assignee: Tulsa Winch, Inc., Jenks, OK (US)

( * ) Notice: Subject to any disclaimer, the term of this patent is extended or adjusted under 35 U.S.C. 154(b) by 386 days.

This patent is subject to a terminal disclaimer.

(21) Appl. No.: 10/892,655

(22) Filed: Jul. 16, 2004

(65) Prior Publication Data

US 2006/0151766 A1 Jul. 13, 2006

(51) Int. Cl.
*B66D 1/48* (2006.01)

(52) U.S. Cl. ..... 254/276; 242/534; 242/563

(58) Field of Classification Search ..... 254/266, 254/267; 242/223, 413.1, 534, 534.2, 563, 242/912

See application file for complete search history.

(56) References Cited

U.S. PATENT DOCUMENTS 2,745,633 A 5/1956 Cornwell
2,776,814 A 1/1957 Sparks
3,742,307 A 6/1973 Patsch et al.
3,750,130 A 7/1973 Lute
3,883,859 A 5/1975 Ancheta
3,922,605 A 11/1975 Sarrell
4,098,221 A 7/1978 Mickelson et al.
4,156,467 A 5/1979 Patton et al.
4,342,028 A 7/1982 Schroeder
4,809,857 A 3/1989 Steuck et al.
5,632,469 A * 5/1997 Heun et al. ..... 254/267
2005/0072965 A1 * 4/2005 Sanders et al. ..... 254/361

FOREIGN PATENT DOCUMENTS

JP 401043498 2/1989

* cited by examiner

*Primary Examiner*—Emmanuel M Marcelo
(74) *Attorney, Agent, or Firm*—Ladas and Parry LLP

(57) ABSTRACT

An apparatus for signaling rotation of a winch in which a rotating gear internal in the winch turns an optical disc with alternating segments of distinguishing features. The disc is then in turn read by an optical sensor that can generate a pulsed output signal based on the travel of the alternating segments on the disc. The output signal of the optical sensor is then conditioned to drive a solenoid that is placed in a control lever of the winch. The optical disc and the optical sensor are part of a self-contained unit which can be inserted internally into the winch housing.

26 Claims, 3 Drawing Sheets

APPARATUS FOR SIGNALING ROTATION OF A WINCH TO AN OPERATOR THEREOF

FIELD OF THE INVENTION

This invention relates to apparatus for signaling rotation of a winch or hoist to an operator thereof and particularly for warning the operator when the drum of the winch or hoist is rotating.

The invention further relates to a method for signaling rotation of the drum to the operator.

BACKGROUND

The operator of a winch or hoist, either on a crane or mounted on a truck cannot always see the load that is being moved which can present a hazard. When an operator is raising or lowering a load, the operator is usually guided by an additional person giving directions either by radio or hand signals. Also known is a device of this type for indicating to the operator when the cable drum of the winch is rotating in either direction to move the load. The device for this can be mechanical or electrical.

It is typical of the present art that a drum rotation indicator is external to the winch and driven by a wheel that rides on a flange of the drum or is shaft-driven to an external output device. Both of these types of systems are susceptible to mechanical or environmental damage.

U.S. Pat. No. 3,922,605 shows an electrical winch drum rotation-indication system with a stepper motor driven from the winch drum to drive a tactile indicator for the operator.

U.S. Pat. No. 4,098,221 shows a drum rotation indicator with a readout plunger, that is located conveniently for the operator's hand. The plunger is moved linearly, in response to rotation of the drum, with sufficient force to give a positive feel, to the operator's hand.

U.S. Pat. No. 4,809,857 shows a drum rotation indicator with a rate generator connected to the winch which develops electrical pulses having a frequency proportional to winch rotational speed. A solenoid having a movable plunger is mounted in the cab of the crane where the vibration of the plunger can be sensed by a crane operator.

The following references are of general interest for showing cable drum indicators. U.S. Pat. No. 2,745,633; U.S. Pat. No. 2,776,814; U.S. Pat. No. 3,742,307; U.S. Pat. No. 3,750,130; U.S. Pat. No. 3,883,859; U.S. Pat. No. 4,156,467; U.S. Pat. No. 4,342,028; JP401043498.

SUMMARY OF THE INVENTION

An object of the invention is to provide apparatus for signaling rotation of a winch to an operator which avoids deficiencies of the known art and which employs an internal system within the winch to generate signals indicative of drum rotation.

The apparatus of the invention employs a system that uses an internal gear-driven optical system that outputs a signal to a solenoid that is incorporated in the operating lever of the winch. The solenoid vibrates as an indication of drum rotation and not necessarily proportional to the speed of the drum.

The invention provides apparatus for signaling rotation of the cable winding drum of the winch to the operating lever of the winch in which a drive means drives the cable winding drum to wind and unwind the cable from the drum and a self-contained optical system is internally supported in the winch and is driven by the drive means to signal rotation of the drum.

The optical system includes an optical disc driven in rotation by the drive means and an optical sensor facing the optical disc to produce pulsed output signals when the optical disc rotates. The pulsed output signals are transmitted to a solenoid operatively associated with the operating lever of the winch to produce vibration of the operating lever when the solenoid receives the pulsed signals from the optical sensor indicating rotation of the cable winding drum.

The self-contained optical system has a housing insertable into the winch for connection of the optical disc to the drive means.

The optical sensor produces pulses in correspondence with rotation of the disc and thereby in correspondence with rotation of the cable winding drum.

The optical disc is round and divided into segments which are alternately distinguished in appearance and the optical sensor is mounted on a fixed disc which is coaxial with the optical disc so that the optical sensor faces the segments on the optical disc as they rotate therepast.

In order to mount the optical system internally in the winch, a tubular sleeve is provided in the winch housing into which the self-contained unit is inserted.

The invention also provides a method for signaling rotation of the drum to the operating lever which comprises the steps of:

- driving the optical sensing unit when the cable winding drum of the winch rotates,
- forming the optical sensing unit with a hollow stationary housing which rotatably supports a drive shaft driven in rotation when the cable winding drum rotates,
- rotating an optical disc of the sensing unit within the interior of the hollow housing by the drive shaft when the drum rotates,
- providing the optical disc with alternating distinguishing segments arranged around the axis of rotation of the optical disc,
- sensing, from within the interior of the hollow housing, passage of the alternating segments as the optical disc rotates,
- producing pulsed output signals based on the passage of the segments, and
- transmitting the pulsed output signals to a solenoid supported by the operating lever to generate vibration of the operating lever and thereby indicate rotation of the cable winding drum to the operator

DETAILED DESCRIPTION OF A PREFERRED EMBODIMENT

Figure 1:
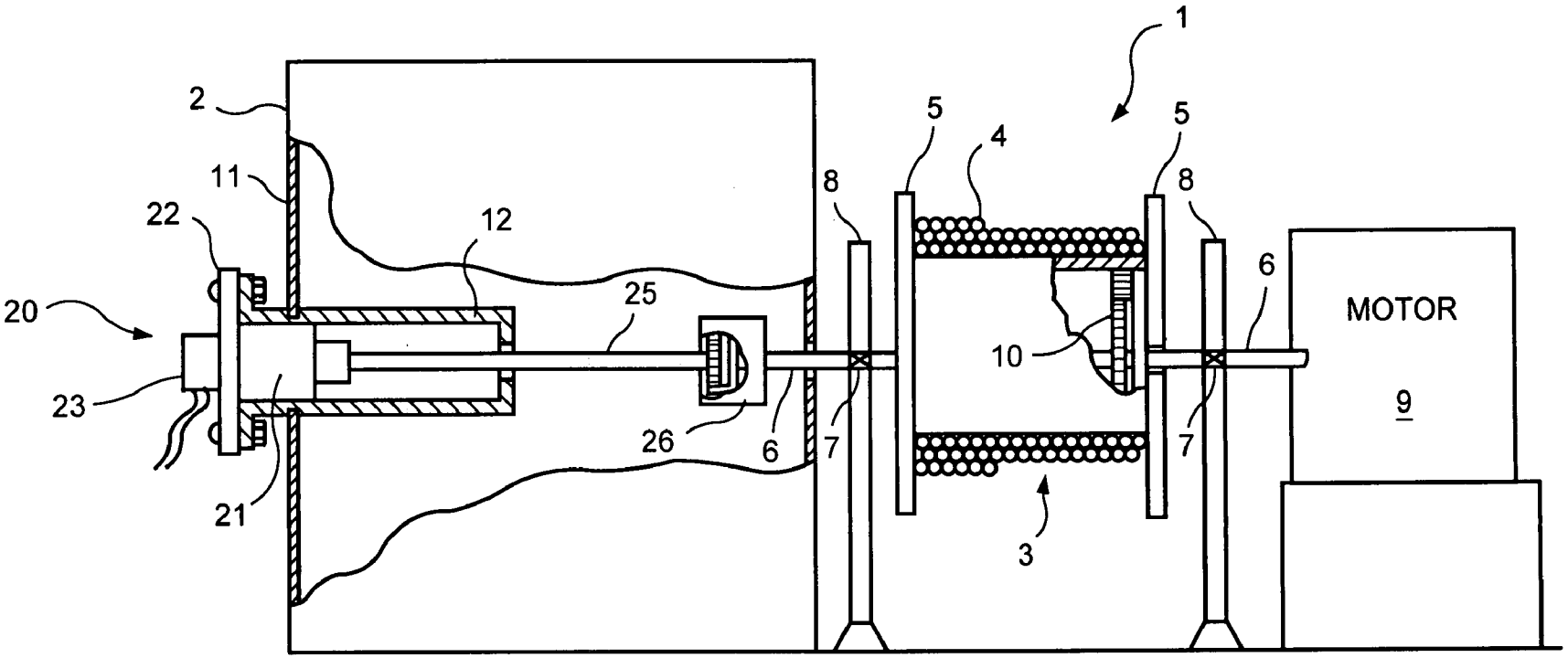
FIG. 1 is a diagrammatic illustration, partly broken away and in section of a winch including a system adapted for signaling rotation of a cable winding drum of the winch to an operating lever of the winch.
Figure 2:
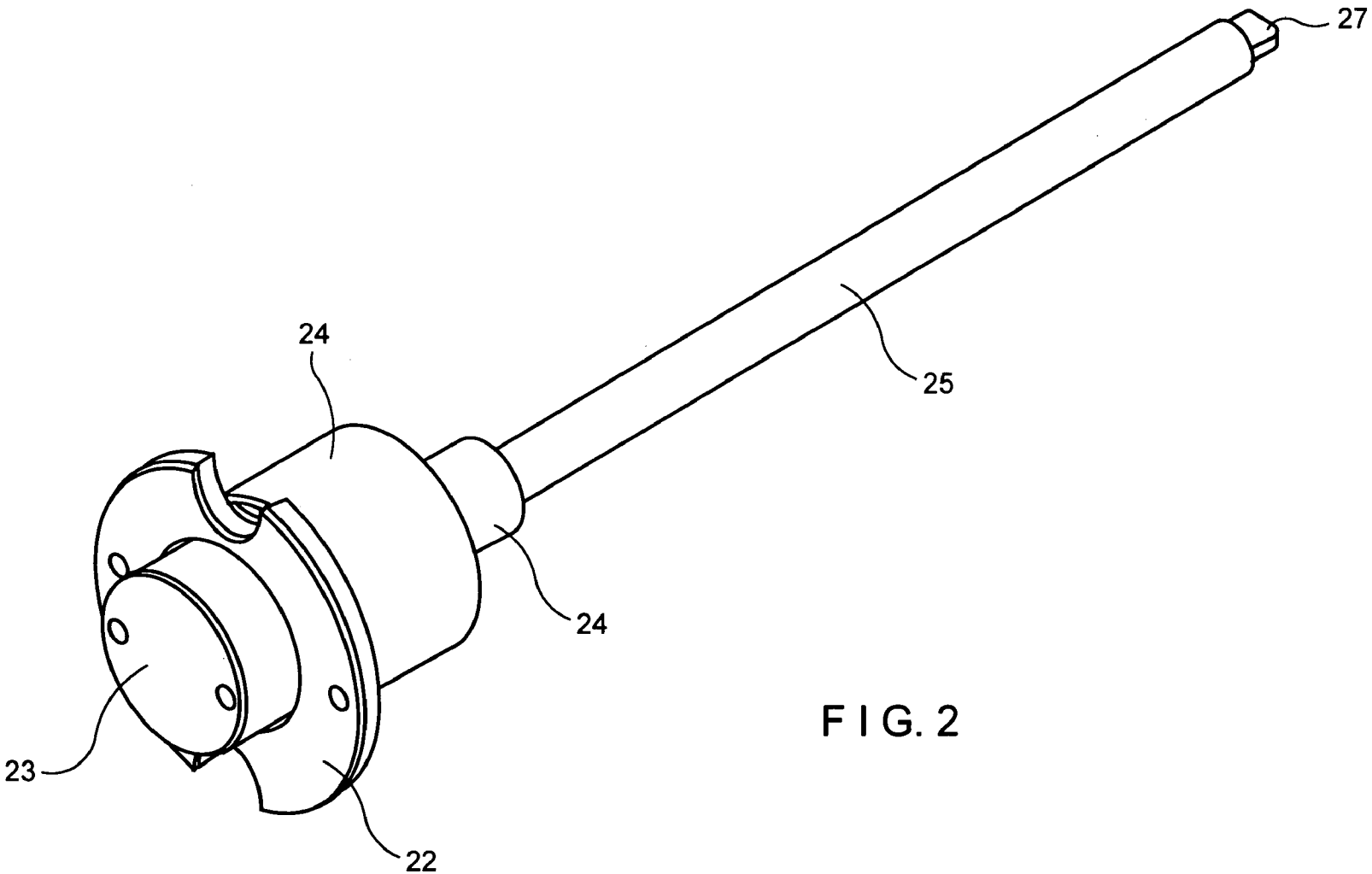
FIG. 2 is a perspective view of a self-contained unit employed in the winch in FIG. 1.
Figure 5:
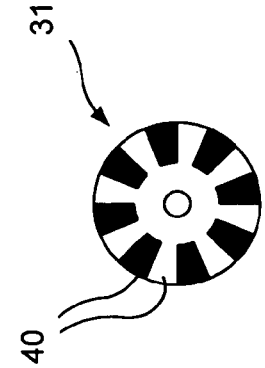
FIG. 5 is a front view of an optical disc of the self-contained unit as seen along line 5—5 in FIG. 3.
Figure 4:
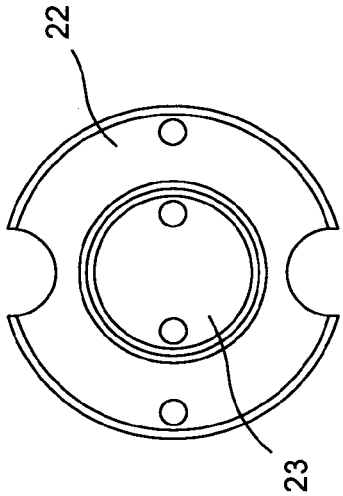
FIG. 4 is an end view of the unit in FIG. 2.

The drawings illustrate a hoist or winch 1 adapted for being mounted on a crane or truck (not shown). The winch 1 is operated by an operator (not shown) seated at a remote location next to an operating lever L which controls operation of the winch. Generally, the operator cannot always see a load being raised or lowered by the winch. The invention provides a system by which the operator is made aware that the winch is operating to raise or lower the load.

The system will be described hereafter with reference to the construction of the winch as illustrated in the drawing.

The winch 1 comprises a housing 2 and a cable winding drum 3 on which a cable 4 is wound or unwound depending on whether the load (not shown) attached to the cable 4 is being raised or lowered. The drum 3 has integral radial flanges 5 at the ends thereof. A rotatable shaft 6 extends through the cable drum 3. The shaft 6 is rotatably supported in bearings 7 supported in pedestals 8. A motor 9 drives the shaft 6 in rotation. The shaft 6 drives a sun planetary gear transmission 10 thereby driving the drum 3 in rotation. The motor 10 is controlled by operation of lever L by the operator in a manner well known to those skilled in the art.

The housing 2 has a side wall 11 to which is secured an open tubular support sleeve 12 which extends into the interior of housing 2.

A self-contained signaling device 20 is secured in tubular support sleeve 12 for detecting rotation of the drum 3.

The device 20 includes a hollow housing 21 which is fitted in support sleeve 12 and secured therewith. The housing 21 has an integral end flange 22 which is secured to an end flange of sleeve 12 to fix the housing 21 within sleeve 12. An end plug 23 is secured in one end of housing 21. A tubular stem 24 is formed at the opposite end of housing 21. A drive shaft 25 is rotatably supported in stem 24 in an axially secured position and drive shaft 25 extends into the interior space in hollow housing 21. The drive shaft 25 is driven from shaft 6 of motor 10 via a gear transmission 26. Although the gear transmission 26 and gear transmission 10 have been shown separately, they can be integrated into a common gear transmission. The drive shaft 25 has a tang 27 at its free end which engages in a drive slot in the gear transmission 26 so that the drive shaft 25 is driven in rotation by the gear transmission 26.

Figure 3:
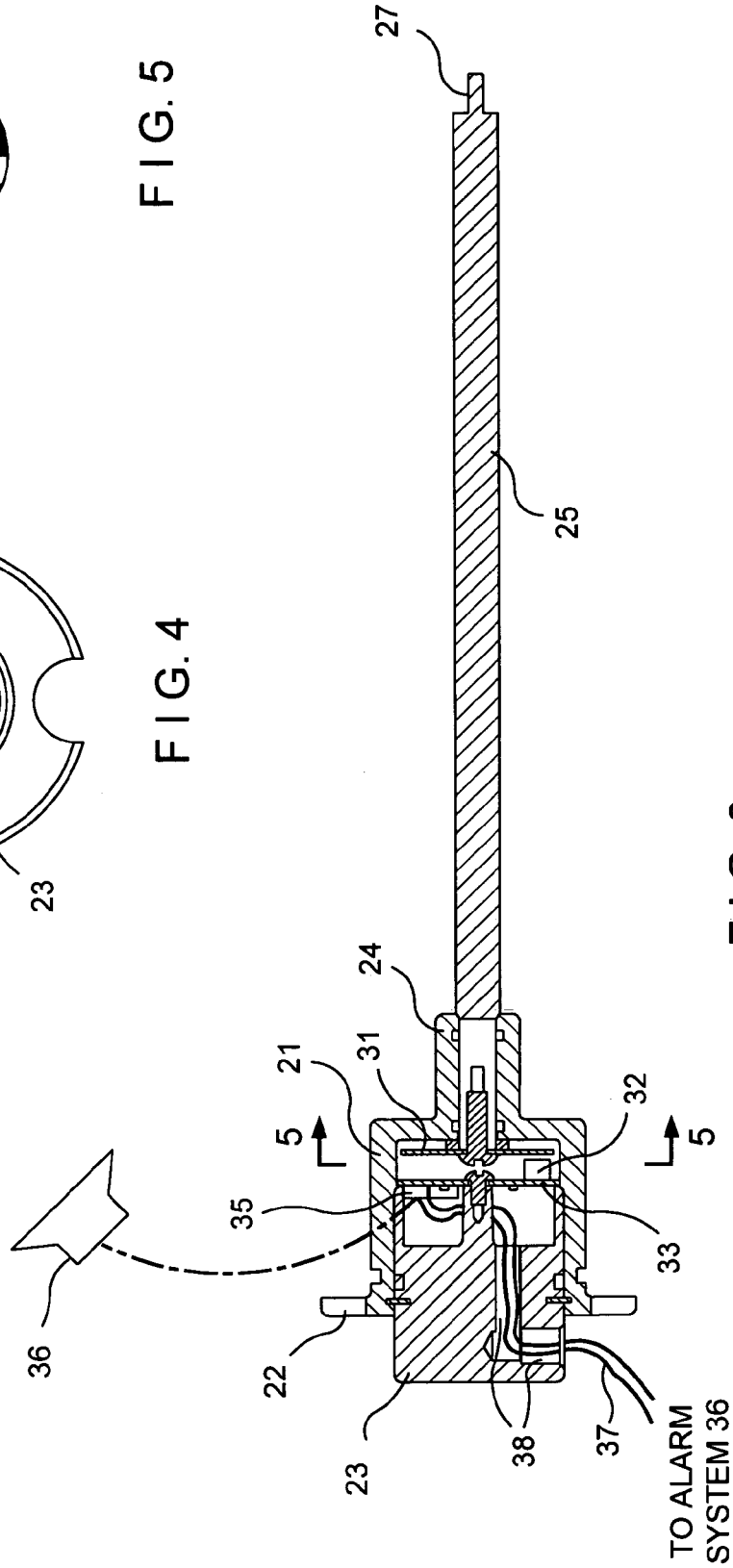
FIG. 3 is a longitudinal sectional view of the unit in FIG. 2.

The self-contained signaling device 20 incorporates a system 30 (FIG. 3) which detects rotation of drive shaft 25 and thereby of drum 3.

The system 30 comprises an optical system which includes an optical disc 31 secured to drive shaft 25 and driven thereby from transmission 26 upon rotation of drum 3 on which the cable is wound and unwound.

The optical disc 31 is divided into a number of equal segments 40 distributed uniformly around the axis of rotation of disc 31. The segments 40 are formed with alternating distinctive features, such as alternating dark and light segments, alternating colors or other distinctive appearance capable of being read by a sensor means 32 facing the optical disc 31. The sensor means 32 is attached to a disc 33 which is fixed to housing 21 by engagement with end plug 23 such that the sensor means 32 is disposed within the interior of hollow housing 21.

The disc 33 is fixed in housing 21 coaxially with optical disc 31 and the sensor means comprises an optical sensor element 34, such as an IR sensor, arranged on the disc 33 to face the segments 40 on optical disc 31. The sensor element 34 produces pulsed output signals as the alternating segments 40 on the optical disc 31 pass the sensor element 34. The pulsed output signals of the optical sensor element 34 are fed to a conditioner circuit 35 fixed to the back surface of disc 33 and from which amplified output signals from the optical sensor element 34 are transmitted to a solenoid 36 by connecting cables 37 extending in passages 38 provided in plug 23. Alternatively, the output signals from the conditioner circuit 35 can be transmitted wirelessly to the solenoid 36, for example, as an RF signal or the like. The conditioner circuit 35 includes its own power supply, for example, a battery.

The solenoid 36 is incorporated into operating lever L so as not to interfere with operation of the lever. The pulsed output signals from the conditioner circuit 35 produce vibration of the solenoid 36 and of the operating lever L in which it is secured.

The optical system comprising the optical disc 31, fixed disc 33 and conditioner circuit 35 is installed in housing 21. Installation of the optical elements of the system therefore only involves mounting discs 31 and 33 within the housing 21. The self-contained unit, inclusive of housing 21, optical discs 31, 33, conditioner circuit 35 and drive shaft 25, is then installed within sleeve 12 such that drive shaft 25 engages gear transmission 26.

Accordingly, the self-contained unit of the invention is simple to install and since the optical system is contained in the hollow space in housing 11 via sleeve 12, the optical system is not subject to external influences and is maintenance free.

Although the invention is disclosed with reference to a particular embodiment thereof, it will become apparent to those skilled in the art that numerous modifications and variations can be made which will fall within the scope and spirit of the invention as defined by the attached claims.

What is claimed is:

1. Apparatus for signaling rotation of a cable winding drum of a winch to an operating lever of the winch, said apparatus comprising:

drive means for driving the cable winding drum to wind and unwind a cable from said drum, a self-contained optical system driven by said drive means, said optical system comprising:

an optical disc driven in rotation by said drive means, an optical sensor facing said optical disc to produce pulsed output signals when said optical disc rotates, and a solenoid receiving said pulsed output signals, said solenoid being operatively associated with the operating lever of the winch to produce vibration of said operating lever when the solenoid receives the pulsed signals from said sensor indicating rotation of said drum, said self-contained optical system including a housing insertable into the winch for connection of said optical disc to said drive means.

2. The apparatus of claim 1, wherein said optical sensor produces pulses upon rotation of said optical disc and thereby upon rotation of said cable winding drum.

3. The apparatus of claim 2, wherein said pulses are transmitted to said solenoid wirelessly.

4. The apparatus of claim 3, wherein the wireless transmission of the pulses is produced by RF signals.

5. The apparatus of claim 1, wherein said optical disc is round and divided into segments which are alternately distinguished in appearance.

6. The apparatus of claim 5, wherein said segments are alternately light and dark.

7. The apparatus of claim 5, wherein said segments are of alternately different colors.

8. The apparatus of claim 1, wherein said housing of the self-contained optical system in hollow and said optical disc and said sensor are supported in the interior of the hollow housing.

9. The apparatus of claim 5, wherein the optical sensor is mounted on a fixed disc which is coaxial with the optical disc and wherein said optical sensor faces said segments on the optical disc.

10. The apparatus of claim 9, wherein said optical sensor includes a conditioner circuit which sends said pulsed output signals to said solenoid.

11. The apparatus of claim 1, wherein said self-contained optical system is insertable as a unit in the apparatus.

12. The apparatus of claim 11, wherein said unit includes a drive shaft supported by said hollow housing for being driven by said drive means, said optical disc being driven by said drive shaft.

13. The apparatus of claim 12, wherein said unit is internally mountable in a winch housing to drivingly connect said drive shaft to said drive means.

14. The apparatus of claim 13, comprising a tubular sleeve in said winch housing into which said hollow housing is inserted when the unit is mounted in the winch housing.

15. The apparatus of claim 13, wherein said fixed disc is secured to said hollow housing.

16. The apparatus of claim 13, wherein said drive shaft projects from said hollow housing internally into the winch housing.

17. An optical system for signaling rotation of a cable winding drum of a winch to an operating lever of the winch, said optical system comprising optical means responsive to rotation of the cable winding drum of the winch to produce pulsed output signals when cable is wound and unwound from the drum, said optical means being disposed in a hollow housing which is insertable into a housing of the winch and which rotatably supports a drive shaft which is driven in rotation when the cable winding drum rotates, said pulsed output signals from the optical means driving a solenoid operatively associated with said operating lever to produce vibration of said operating lever.

18. The system of claim 17, wherein said optical means comprises a rotatable optical disc which is rotated by a drive shaft when said drum rotates, and an optical sensor means facing said optical disc for producing said pulsed output signals as the optical disc rotates.

19. The system of claim 18, wherein said optical sensor means and said optical disc face one another in said hollow housing.

20. The system of claim 18, wherein said optical means, said hollow housing and said drive shaft form a self-contained unit which is insertable in the housing of the winch.

21. The system of claim 17, wherein said optical sensor means is wirelessly connected to said solenoid.

22. A method of signaling rotation of a cable winding drum of a winch to an operating lever of the winch, comprising the steps of:

driving an optical sensing unit when the cable winding drum of the winch rotates, forming said optical unit with a hollow stationary housing rotatably supporting a drive shaft driven in rotation when the cable winding drum rotates, rotating an optical disc of the sensing unit within the interior of said hollow housing by said drive shaft, forming said optical disc with alternating distinguishing segments arranged around an axis of rotation of the optical disc, sensing, from within the interior of the hollowing housing, passage of the alternating segments past a sensor as said optical disc rotates, producing pulsed output signals from the sensor based on the passage of said segments, and transmitting said pulsed output signals to a solenoid supported by the operating lever to generate vibration of the operating lever to thereby indicate rotation of the cable winding drum.

23. The method of claim 22, comprising forming said segments as light and dark segments.

24. The method of claim 23, comprising forming said segments with different colors.

25. The method of claim 22, comprising transmitting said output signals wirelessly to the solenoid.

26. The method of claim 22, wherein said optical sensing unit is inserted inside a winch housing to drivingly connect said drive shaft of the optical sensing unit with a drive means of the cable winding drum.

* * * * *